US008157602B2

(12) United States Patent
Copper et al.

(10) Patent No.: US 8,157,602 B2
(45) **Date of Patent: *Apr. 17, 2012**

(54) WEDGE TAP CONNECTOR

(75) Inventors: Charles Dudley Copper, Hummelstown, PA (US); Ned E. Corman, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 2 days.

This patent is subject to a terminal disclaimer.

(21) Appl. No.: 12/899,381

(22) Filed: Oct. 6, 2010

(65) Prior Publication Data

US 2011/0028052 A1 Feb. 3, 2011

Related U.S. Application Data

(63) Continuation of application No. 11/897,576, filed on Aug. 29, 2007, now Pat. No. 7,819,706.

(51) Int. Cl.
*H01R 4/50* (2006.01)

(52) U.S. Cl. ..... 439/783

(58) Field of Classification Search ..... 439/782, 439/853, 836, 835

See application file for complete search history.

(56) References Cited

U.S. PATENT DOCUMENTS 3,235,944 A 2/1966 Broske
3,280,856 A 10/1966 Broske et al.
3,329,928 A 7/1967 Broske
3,349,167 A * 10/1967 Mixon, Jr. et al. ..... 174/94 R
3,588,791 A 6/1971 Polidori
3,811,105 A 5/1974 Gerhard
4,027,939 A 6/1977 White
4,247,159 A 1/1981 Fruchard
4,279,461 A 7/1981 Bussen et al.
4,471,159 A 9/1984 Frank, Jr.
4,600,264 A 7/1986 Counsel
4,650,273 A * 3/1987 Roosdrop ..... 439/783
4,684,196 A 8/1987 Smith et al.
4,723,921 A 2/1988 Pooley
4,730,087 A 3/1988 Werner
4,764,131 A 8/1988 Beinhaur
4,863,403 A 9/1989 Shannon
4,915,653 A 4/1990 Mair (Continued)

OTHER PUBLICATIONS

Sprecher, J. D. et al; "Wedge-Connector Technology in Power Utility Applications"; Copyright 2004 by Tyco Electronics Corporation; AMP Journal of Technology vol. 5 Jun. 1996; 10 pgs.

(Continued)

*Primary Examiner* — Phuong Dinh

(57) ABSTRACT

An electrical connector assembly includes a spring member having a generally C-shaped body extending between a leading edge and a trailing edge. The C-shaped body is formed by a first hook portion, a second hook portion, and a central section extending between the first hook portion and the second hook portion. Each of the hook portions are adapted to receive a conductor. The spring member is movable between a normal position and a deflected position, wherein in the deflected position, the spring member imparts a clamping force on the first and second conductors. The assembly further includes a wedge member having a leading end and a trailing end. The wedge is positionable within the spring member to drive the spring member from the normal position to the deflected position, wherein the wedge has an initial position and a final position corresponding to the deflected position of the spring member. Relative positions of the wedge member with respect to the spring member in the initial position and the final position vary based on a size of the conductors.

20 Claims, 6 Drawing Sheets

U.S. PATENT DOCUMENTS

| | | | | |
|---|---|---|---|---|
| 5,092,797 | A | 3/1992 | Cole et al. | |
| 5,342,224 | A | 8/1994 | Lefavour | |
| 5,423,699 | A | 6/1995 | Johnson | |
| 5,692,930 | A | 12/1997 | Garver et al. | |
| 5,704,816 | A | 1/1998 | Polidori | |
| 5,752,860 | A | 5/1998 | Greaves | |
| 5,774,987 | A | 7/1998 | Chadbourne et al. | |
| 5,830,019 | A | 11/1998 | Chadbourne et al. | |
| 5,862,589 | A | 1/1999 | Chadbourne et al. | |
| 6,004,165 | A | 12/1999 | Dinh et al. | |
| 6,086,406 | A | 7/2000 | Francois et al. | |
| 6,120,334 | A | 9/2000 | Timsit et al. | |
| 6,517,391 | B1 | 2/2003 | Chadbourne | |
| 6,595,472 | B1 | 7/2003 | Pisczak | |
| 7,341,495 | B1 | 3/2008 | Ulemek et al. | |
| 7,819,706 | B2 * | 10/2010 | Copper et al. | 439/783 |
| 2002/0142674 | A1 | 10/2002 | Chadbourne et al. | |

OTHER PUBLICATIONS

PCT International Search Report; International Application No. PCT/US2008/010113; International Filing Date Aug. 26, 2008; 5 pgs.

* cited by examiner

WEDGE TAP CONNECTOR

CROSS REFERENCE TO RELATED APPLICATION

The present application is a continuation of and claims priority from Ser. No. 11/897,576, now U.S. Pat. No. 7,819,706 filed Aug. 29, 2007, titled "WEDGE TAP CONNECTOR", the complete subject matter of which is hereby expressly incorporated by reference in its entirety.

BACKGROUND OF THE INVENTION

This invention relates generally to electrical connectors, and more particularly, to power utility connectors for mechanically and electrically connecting a tap or distribution conductor to a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. For example, proper installation of such connectors is often dependent upon predetermined torque requirements of the bolt connection to achieve adequate connectivity of the main and tap conductors. Applied torque in tightening the bolted connection generates tensile force in the bolt that, in turn, creates normal force on the conductors between the connector halves. Applicable torque requirements, however, may or may not be actually achieved in the field and even if the bolt is properly tightened to the proper torque requirements initially, over time, and because of relative movement of the conductors relative to the connector pieces or compressible deformation of the cables and/or the connector pieces over time, the effective clamping force may be considerably reduced. Additionally, the force produced in the bolt is dependent upon frictional forces in the threads of the bolt, which may vary considerably and lead to inconsistent application of force among different connectors.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from Tyco Electronics Corporation of Harrisburg, Pa. and is known as an AMPACT Tap or Stirrup Connector. AMPACT connectors include different sized channel members to accommodate a set range of conductor sizes, and multiple wedge sizes for each channel member. Each wedge accommodates a different conductor size. As a result, AMPACT connectors tend to be more expensive than either bolt-on or compression connectors due to the increased part count. For example, a user may be required to possess three channel members that accommodate a full range of conductor sizes. Additionally, each channel member may require up to five wedge members to accommodate each conductor size for the corresponding channel member. As such, the user must carry many connector assemblies in the field to accommodate the full range of conductor sizes. The increased part count increases the overall expense and complexity of the AMPACT connectors.

AMPACT connectors are believed to provide superior performance over bolt-on and compression connectors. For example, the AMPACT connector results in a wiping contact surface that, unlike bolt-on and compression connectors, is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

It would be desirable to provide a lower cost, more universally applicable alternative to conventional wedge connectors that provides superior connection performance to bolt-on and compression connectors.

BRIEF DESCRIPTION OF THE INVENTION

In one aspect, an electrical connector assembly is provided including a spring member having a generally C-shaped body extending between a leading edge and a trailing edge. The C-shaped body is formed by a first hook portion, a second hook portion, and a central section extending between the first hook portion and the second hook portion. Each of the hook portions are adapted to receive a conductor. The spring member is movable between a normal position and a deflected position, wherein in the deflected position, the spring member imparts a clamping force on the first and second conductors. The assembly further includes a wedge member having a leading end and a trailing end. The wedge is positionable within the spring member to drive the spring member from the normal position to the deflected position, wherein the wedge has an initial position and a final position corresponding to the deflected position of the spring member. Relative positions of the wedge member with respect to the spring member in the initial position and the final position vary based on a size of the conductors.

Optionally, the wedge member may be movable a distance from the initial position to the final position, wherein the distance corresponds to a predetermined amount of deflection of the spring member. The spring member may have a first length and the wedge member may have a second length, wherein the second length is at least twice the first length. The wedge member may be movable less than one half the length of the wedge member from the initial position to the final position. Optionally, the wedge member may impart a partial clamping force on the conductors when the wedge member is positioned in the initial position.

In another aspect, an electrical connector system is provided for power utility transmission. The system includes a main power line conductor, a tap line conductor, and a spring member having a generally C-shaped body extending between a leading edge and a trailing edge. The C-shaped body defines a pair of conductor receiving portions, wherein a first of the conductor receiving portions adapted to engage the main power line conductor and the second conductor receiving portion adapted to engage the tap line conductor. The spring member is movable between a normal position and a deflected position, wherein in the deflected position, the spring member imparts a clamping force on the main power line and tap line conductors. The system also includes a wedge member having a leading end and a trailing end. The wedge is positionable within the spring member to drive the spring member from the normal position to the deflected position. The wedge has an initial position and a final position corresponding to the deflected position of the spring member. The relative positions of the wedge member with respect to the spring member in the initial position and the final position vary depending on a size of the conductors.

DETAILED DESCRIPTION OF THE INVENTION

Figure 1:
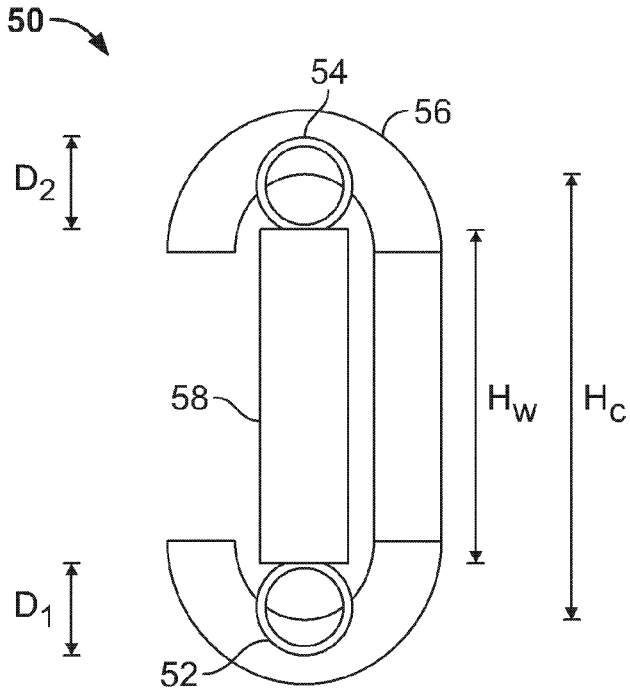
FIG. 1 (Prior Art)
FIG. 1 is a side elevational view of a known wedge connector assembly.
Figure 2:
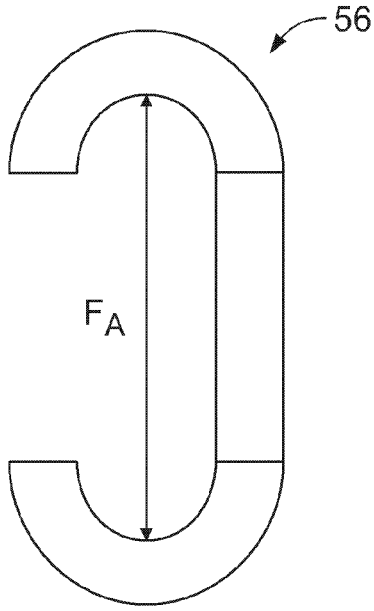
FIG. 2 (Prior Art)
FIG. 2 is a side elevational view of a portion of the assembly shown in FIG. 1.

FIGS. 1 and 2 illustrate a known wedge connector assembly 50 for power utility applications wherein mechanical and electrical connections between a tap or distribution conductor 52 and a main power conductor 54 are to be established. The connector assembly 50 includes a C-shaped spring member 56 and a wedge member 58. The spring member 56 hooks over the main power conductor 54 and the tap conductor 52, and the wedge member 58 is driven through the spring member 56 to clamp the conductors 52, 54 between the ends of the wedge member 58 and the ends of the spring member 56.

The wedge member 58 may be installed with special tooling having for example, gunpowder packed cartridges, and as the wedge member 58 is forced into the spring member 56, the ends of the spring member 56 are deflected outwardly and away from one another via the applied force $F_A$ shown in FIG. 2. Typically, the wedge member 58 is fully driven to a final position wherein the rear end of the wedge member 58 is substantially aligned with the rear edge of the spring member 56. Additionally, the amount of deflection of the ends of the spring member 56 is determined by the size of the conductors 52 and 54. For example, the deflection is greater for the larger diameter conductors 52 and 54.

As shown in FIG. 1, the wedge member 58 has a height $H_W$, while the spring member 56 has a height $H_C$ between opposing ends of the spring member 56 where the conductors 52, 54 are received. The tap conductor 52 has a first diameter $D_1$ and the main conductor 54 has a second diameter $D_2$ that may be the same or different from $D_1$. As is evident from FIG. 1, $H_W$ and $H_C$ are selected to produce interference between each end of the spring member 56 and the respective conductor 52, 54. Specifically, the interference I is established by the relationship:

$$I=H_W+D_1+D_2-H_C \quad (1)$$

With strategic selection of $H_W$ and $H_C$ the actual interference I achieved may be varied for different diameters $D_1$ and $D_2$ of the conductors 52 and 54. Alternatively, $H_W$ and $H_C$ may be selected to produce a desired amount of interference I for various diameters $D_1$ and $D_2$ of the conductors 52 and 54. For example, for larger diameters $D_1$ and $D_2$ of the conductors 52 and 54, a smaller wedge member 58 having a reduced height $H_W$ may be selected. Alternatively, a larger spring member 56 having an increased height $H_C$ may be selected to accommodate the larger diameters $D_1$ and $D_2$ of the conductors 52 and 54. As a result, a user requires multiple sized wedge members 52 and/or spring members 56 in the field to accommodate a full range of diameters $D_1$ and $D_2$ of the conductors 52 and 54. Consistent generation of at least a minimum amount of interference I results in a consistent application of applied force $F_A$ which will now be explained in relation to FIG. 3.

Figure 3:
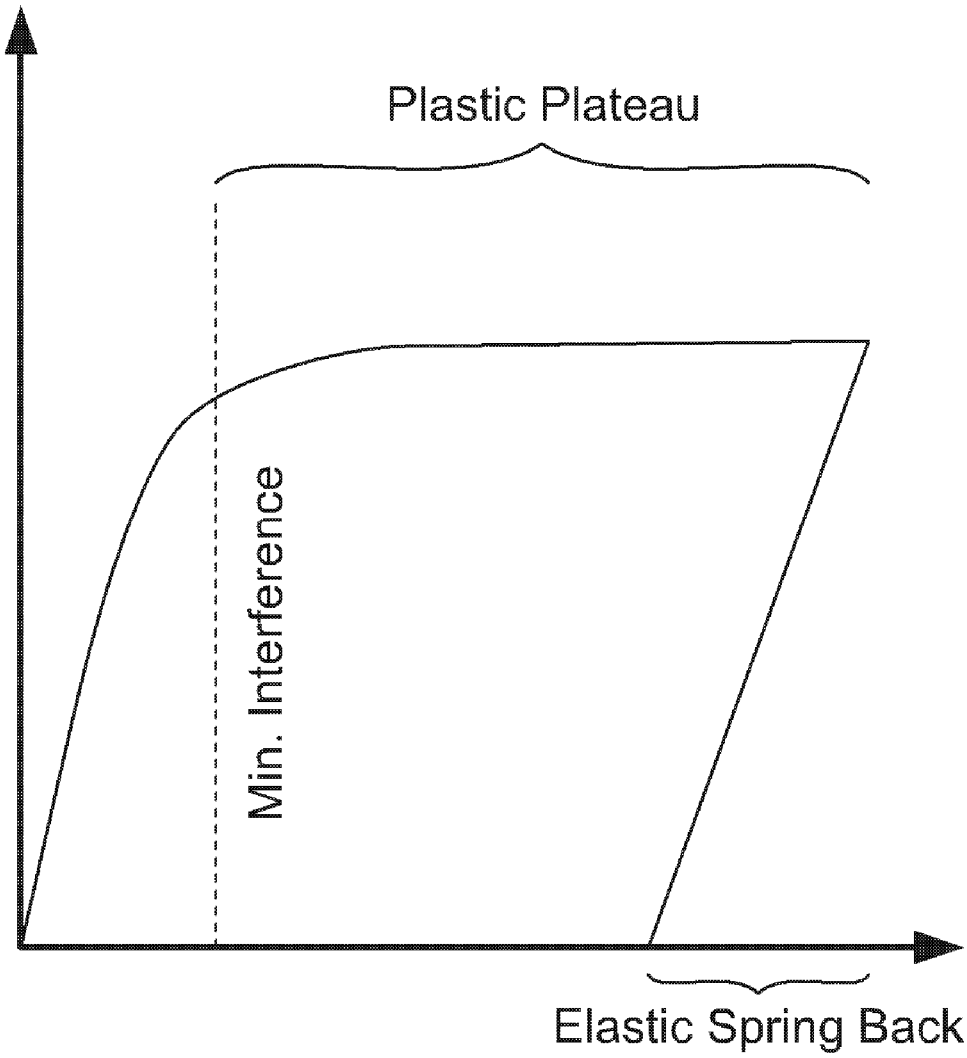
FIG. 3 is a force/displacement graph for the assembly shown in FIG. 1.

FIG. 3 illustrates an exemplary force versus displacement curve for the assembly 50 shown in FIG. 1. The vertical axis represents the applied force and the horizontal axis represents displacement of the ends of the spring member 56 as the wedge member 58 is driven into engagement with the conductors 52, 54 and the spring member 56. As FIG. 3 demonstrates, a minimum amount of interference, indicated in FIG. 3 with a vertical dashed line, results in plastic deformation of the spring member 56 that, in turn, provides a consistent clamping force on the conductors 52 and 54, indicated by the plastic plateau in FIG. 3. The plastic and elastic behavior of the spring member 56 is believed to provide repeatability in clamping force on the conductors 52 and 54 that is not possible with known bolt-on connectors or compression connectors. A need for an inventory of differently sized spring members 56 and wedge members 58 renders the connector assembly 50 more expensive and less convenient than some user's desire.

Figure 4:
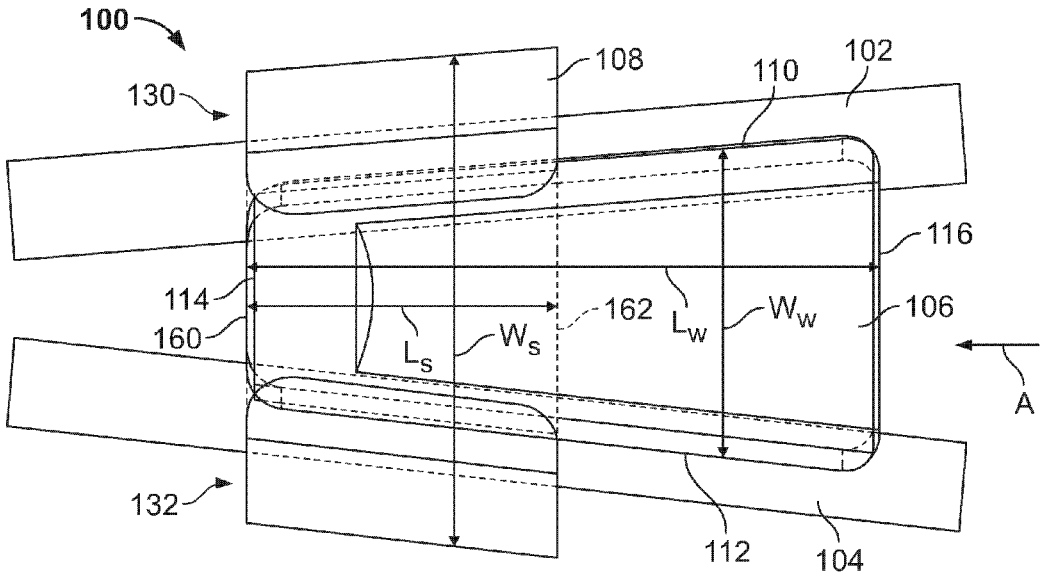
FIG. 4 is a top view of a connector assembly in an unmated position and formed in accordance with an exemplary embodiment of the invention.
Figure 5:
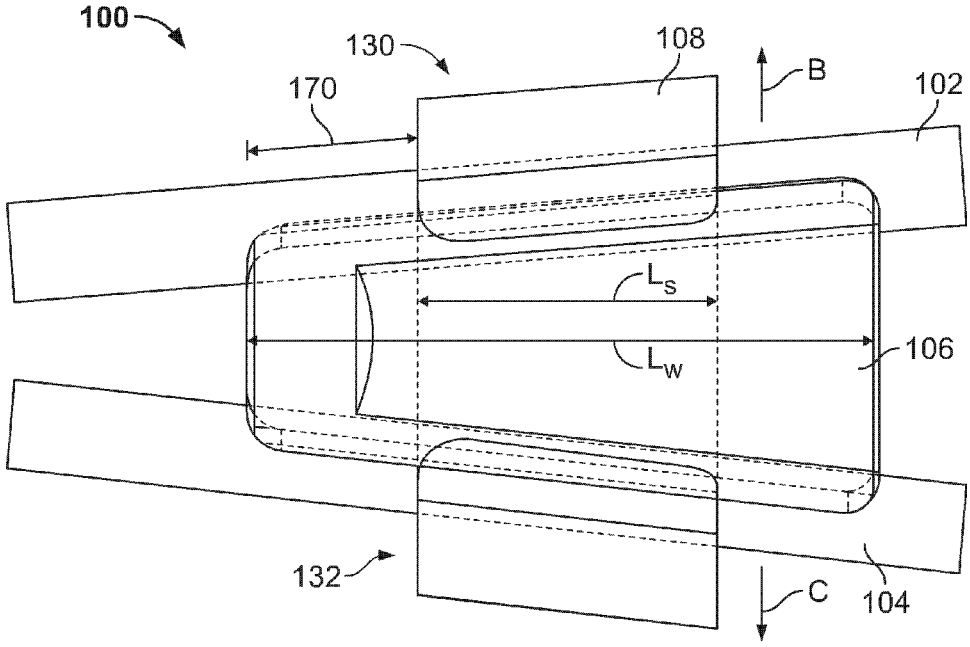
FIG. 5 is a top view of the assembly shown in FIG. 4 in a mated position.
Figure 7:
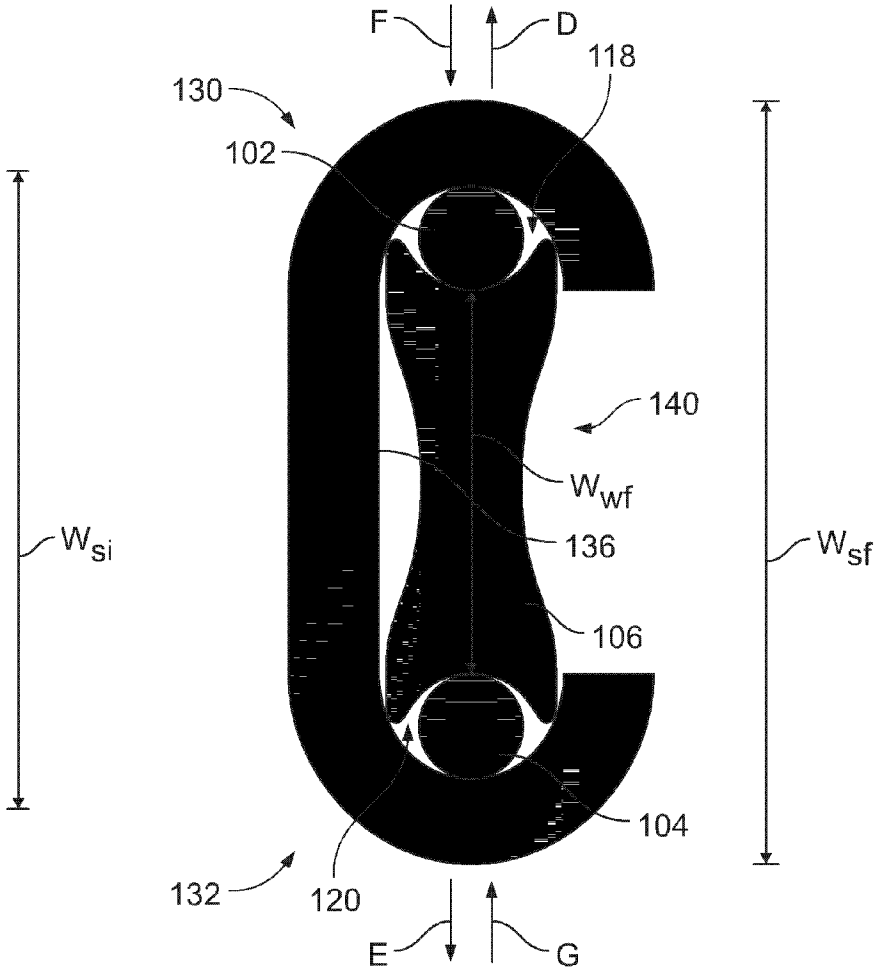
FIG. 7 is a cross sectional view of the assembly shown in FIG. 5 in the mated position.
Figure 6:
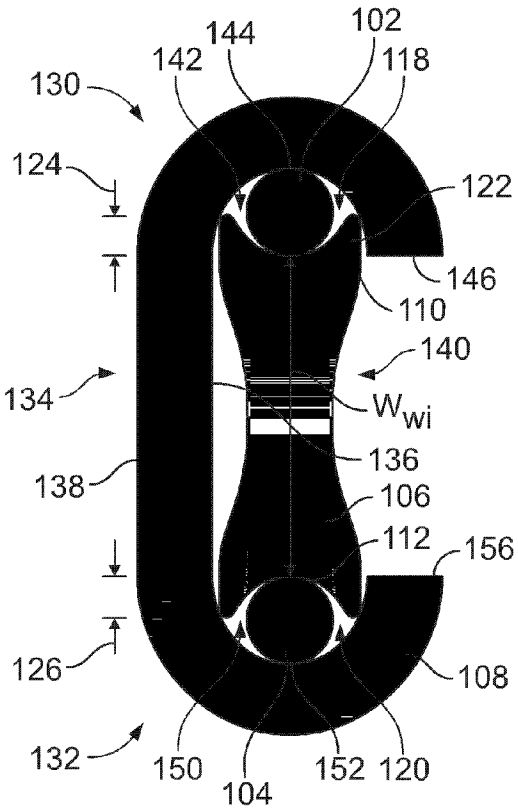
FIG. 6 is a cross sectional view of the assembly shown in FIG. 5 in the unmated position.

A connector assembly 100 is provided that overcomes these and other disadvantages. The connector assembly 100 is described with reference to FIGS. 4-7. FIG. 4 is a top view of a connector assembly 100 in an unmated position and formed in accordance with an exemplary embodiment of the invention. FIG. 5 is a top view of the connector assembly 100 in a mated position. FIG. 6 is a cross sectional view of the connector assembly 100 shown in FIG. 5 in the unmated position. FIG. 7 is a cross sectional view of the connector assembly 100 shown in FIG. 5 in the mated position. The connector assembly 100 is adapted for use as a tap connector for connecting a tap conductor 102 to a main conductor 104 of a utility power distribution system. As explained in detail below, the connector assembly 100 provides superior performance and reliability to known bolt-on and compression connectors, while providing ease of installation and greater range taking capability to known wedge connector systems.

The tap conductor 102, sometimes referred to as a distribution conductor, may be a known high voltage cable or line having a generally cylindrical form in an exemplary embodiment. The main conductor 104 may also be a generally cylindrical high voltage cable line. The tap conductor 102 and the main conductor 104 may be of the same wire gauge or different wire gauge in different applications and the connector assembly 100 is adapted to accommodate a range of wire gauges for each of the tap conductor 102 and the main conductor 104.

When installed to the tap conductor 102 and the main conductor 104, the connector assembly 100 provides electrical connectivity between the main conductor 104 and the tap conductor 102 to feed electrical power from the main conductor 104 to the tap conductor 102 in, for example, an electrical utility power distribution system. The power distribution system may include a number of main conductors 104 of the same or different wire gauge, and a number of tap conductors 102 of the same or different wire gauge. The connector assembly 100 may be used to provide tap connections between main conductors 104 and tap conductors 102 in the manner explained below.

As shown in FIG. 4, the connector assembly 100 includes a wedge member 106 and a C-shaped spring member 108 that couples the tap conductor 102 and the main conductor 104 to one another. In an exemplary embodiment, the wedge member 106 includes first and second sides 110 and 112, respectively, which extend between a leading end 114 and a trailing end 116. The first and second sides 110 and 112 are tapered from the trailing end 116 to the leading end 114, such that a cross-sectional width $W_w$ between the first and second sides 110 and 112 is greater proximate the trailing end 116 than the leading end 114. The tapered first and second sides 110 and 112 form a wedge shaped body for the wedge member 106. The wedge member 106 has a length $L_w$ measured between the leading end 114 and the trailing end 116. Optionally, the length $L_w$ is substantially greater than the width $W_w$. In the illustrated embodiment, the length $L_w$ is approximately three times the width $W_w$ at the leading end 114 and twice the width $W_w$ at the trailing end 114. In an exemplary embodiment, the length $L_w$ is approximately four inches, however, it is realized that the length $L_w$ may be greater than or less than four inches in alternative embodiments.

As best illustrated in FIG. 6, each of the first and second sides 110 and 112 include concave indentations that represent conductor receiving channels, identified generally at 118 and 120, respectively. The channels 118, 120 have a predetermined radius that cups the conductors 102, 104 to position the conductors 102, 104 with respect to the spring member 108. The formation and geometry of the wedge member 106 provides for interfacing with differently sized conductors 102, 104 while achieving a repeatable and reliable interconnection of the wedge member 106 and the conductors 102, 104. In an exemplary embodiment, lips 122 of the channels 118, 120 are spaced apart to accommodate differently sized conductors 102, 104, and the channels 118, 120 have depths 124 and 126, respectively, for accommodating differently sized conductors 102, 104. In one embodiment, the channels 118 and 120 are substantially identically formed and share the same geometric profile and dimensions to facilitate capturing of the conductors 102 and 104 between the wedge member 106 and the spring member 108 during mating. The channels 118 and 120, however, may be differently dimensioned as appropriate to be engaged to differently sized conductors 102, 104 while maintaining substantially the same shape of the wedge member 106. For example, the depths 124 and 126 may be different such that the one of the channels 118 or 120 may accommodate larger sized conductors and the other of the channels 118 or 120 may accommodate smaller sized conductors. In an exemplary embodiment, the depths 124 and 126 are selected to be less than one half of the diameter of the conductors 102 and 104. As such, the sides 110 and 112 do not interfere with the spring member 108, thus the force of the spring member 108 is applied entirely to the conductors 102 and 104. Optionally, the radius and/or depths 124, 126 of the channels 118, 120 may vary or be non-uniform along the length of the channels 118, 120. For example, because the wedge member 106 engages larger sized conductors 102, 104 proximate the leading end 114, the radius of the channels 118, 120 proximate the leading end 114 may be wider than at the trailing end 116.

Still referring to FIG. 6, the C-shaped spring member 108 includes a first hook portion 130, a second hook portion 132, and a central portion 134 extending therebetween. The spring member 108 further includes an inner surface 136 and an outer surface 138. The spring member 108 forms a chamber 140 defined by the inner surface 136 of the spring member 108. The conductors 102, 104 and the wedge member 106 are received in the chamber 140 during assembly of the connector assembly 100.

In an exemplary embodiment, the first hook portion 130 forms a first contact receiving portion or cradle 142 positioned at an end of the chamber 140. The cradle 142 is adapted to receive the tap conductor 102 at an apex 144 of the cradle 142. A distal end 146 of the first hook portion 130 includes a radial bend that wraps around the tap conductor 102 for about 180 circumferential degrees in an exemplary embodiment, such that the distal end 146 faces toward the second hook portion 132. Similarly, the second hook portion 132 forms a second contact receiving portion or cradle 150 positioned at an opposing end of the chamber 140. The cradle 152 is adapted to receive the main conductor 104 at an apex 152 of the cradle 150. A distal end 156 of the second hook portion 132 includes a radial bend that wraps around the main conductor 104 for about 180 circumferential degrees in an exemplary embodiment, such that the distal end 156 faces toward the first hook portion 130. The spring member 108 may be integrally formed and fabricated from extruded metal in a relatively straightforward and low cost manner.

Returning to FIG. 4, the spring member 108 further includes a leading edge 160 and a trailing edge 162. The first and second hook portions 130 and 132 are tapered from the trailing edge 162 to the leading edge 160, such that a cross-sectional width $W_s$ between the first and second hook portions 130 and 132 is greater proximate the trailing edge 162 than the leading edge 160. The spring member 108 has a length $L_s$ measured between the leading edge 160 and the trailing edge 162. Optionally, the length $L_s$ is slightly less than the width $W_s$. In an exemplary embodiment, the length $L_s$ is between approximately one and a half and two inches. In an exemplary embodiment, the spring member width $W_s$ is greater than the wedge member width $W_w$ such that the wedge member 106 may be received within the spring member 108. The spring member length $L_s$ is less than the wedge member length $L_w$ such that the wedge member 106 may be positioned at multiple positions with respect to the spring member 108 during use of the connector assembly 100, as will be described in further detail below. Optionally, the spring member length $L_s$ may be less than the wedge member length $L_w$ by at least a travel distance of the wedge member 106. The lengths may be selected to accommodate a range of conductor sizes. For example, the wedge member length $L_w$ may be between approximately 0.5 inch and 3 inches longer than the spring member length $L_s$. The greater the difference in length, the greater the range accommodation of the connector assembly 100. In the illustrated embodiment, the wedge member length $L_w$ is approximately 3 inches longer than the spring member length $L_s$. Optionally, the wedge member length $L_w$ may be between approximately 1.25 and 4 times the spring member length $L_s$. In the illustrated embodiment, the wedge member length is approximately twice the spring member length $L_s$.

The wedge member 106 and the spring member 108 are separately fabricated from one another or otherwise formed into discrete connector components and are assembled to one another as explained below. While one exemplary shape of the wedge and spring members 106, 108 has been described herein, it is recognized that the members 106, 108 may be alternatively shaped in other embodiments as desired.

During assembly of the connector assembly 100, the tap conductor 102 and the main conductor 104 are positioned within the chamber 140 and placed against the inner surface 136 of the first and second hook portions 130 and 132, respectively. The wedge member 106 is then positioned between the conductors 102, 104 such that the conductors 102, 104 are received within the channels 118, 120. The wedge member 106 is moved forward, in the direction of arrow A shown in FIG. 4, to an initial position. The initial position of the wedge member 106 with respect to the spring member 108 is dependent upon the size or gauge of the conductors 102, 104. With a larger gauge, the initial position of the wedge member 106 is more rearward. With a smaller gauge, the initial position of the wedge member 106 is more forward. In the initial position, the conductors 102, 104 are held tightly between the wedge member 106 and the spring member 108 but the spring member 108 remains largely un-deformed. In an exemplary embodiment, no gaps or spaces exist between the conductors 102, 104 and either of the wedge member 106 or the spring member 108. Optionally, the hook portions 130, 132 of the spring member 106 may be partially deflected outward, in the direction of arrows B and C, in the initial position. In an exemplary embodiment, the wedge member 106 is pressed hand-tight within the spring member 108 by the user such that the spring member 108 is minimally deflected. By pressing hand-tight, a user is able to exert an applied force $F_a$ to the spring member 108 on the order of 100 lbs of clamping force against the conductors 102, 104.

Figure 8:
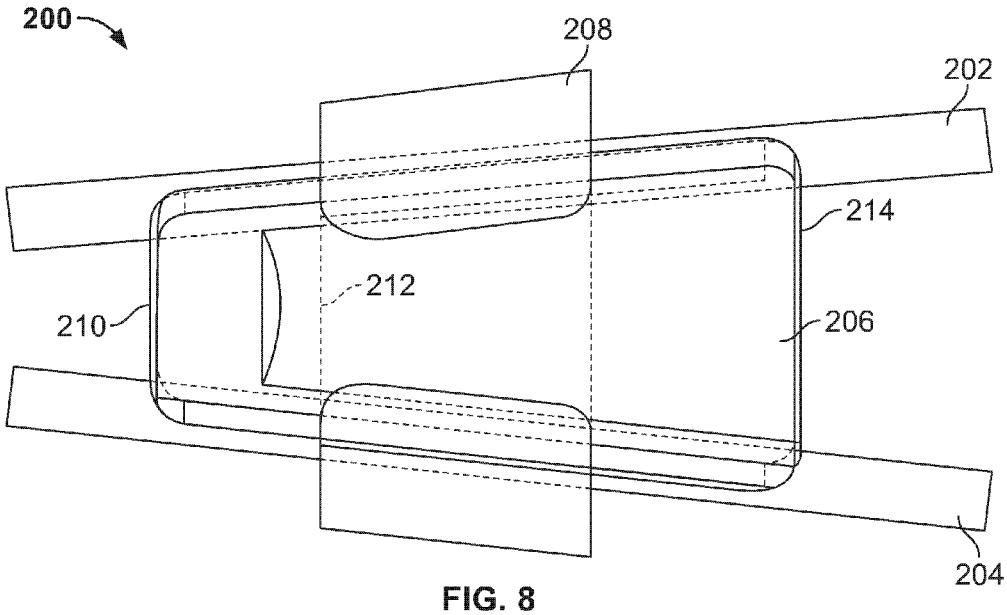
FIG. 8 is a top view of the assembly shown in FIG. 3 in an unmated position and formed in accordance with another exemplary embodiment of the present invention.

Turing to FIG. 4, an exemplary unmated, initial position of the wedge member 106 with respect to the spring member 108 is illustrated. In the initial position illustrated in FIG. 4, the leading end 114 of the wedge member 106 is substantially aligned with the leading edge 160 of the spring member 108. However, other initial positions are possible in other embodiments. For example, as indicated above, because the initial position depends upon the size of the conductors 102, 104, the initial position may be different if different sized conductors 102, 104 are used. The conductors 102, 104 illustrated in FIG. 4 are near an upper range of conductor size accommodated by the connector assembly 100. As a result, the initial position of the wedge member 106 is proximate a rearward-most initial position. For example, the tap conductor 102 illustrated in FIG. 4 is a 3/0 or three nought gauge conductor and the main conductor 104 is a 4/0 or four nought gauge conductor. In comparison, the conductors 202, 204 illustrated in FIG. 8 are near a lower range of conductor size accommodated by the connector assembly 100. As a result, the initial position of the wedge member 106 is proximate a forward-most initial position. For example, the tap conductor 202 is a 6 gauge conductor and the main conductor 204 is a 4 gauge conductor.

During mating, the wedge member 106 is pressed forward into the spring member 108 by a tool to a final, mated position. As the wedge member 106 is pressed into the spring member 108, the hook portions 130 is deflected outward in the direction of arrow B, and the hook portion 132 is deflected outward in the direction of arrow C. The wedge member 106 is moved a distance 170 during the mating process to a final position, shown in FIG. 5. The wedge member length $L_w$ is larger than the spring member length $L_s$ plus the length 170 to allow for the range of movement of the wedge member 108 with respect to the spring member 106. In an exemplary embodiment, the distance 170 is approximately one quarter of the length $L_w$ of the wedge member 106. Optionally, the distance 170 may be approximately one half of the length $L'_s$ of the spring member 108. Alternatively, the distance 170 may be approximately equal to the length $L_s$ of the spring member 108. In one embodiment, the distance 170 is approximately one inch. Optionally, the distance 170 may be the same for each embodiment of the connector assembly 100 and for each conductor 102, 104 size. Because the distance 170 directly corresponds to the deflection of the spring member 108, repeatably moving the same distance 170 during mating corresponds to repeatably having the same amount of deflection of the spring member 108, irrespective of the conductor size. The length 170 is dictated by the tapered angle of the wedge member 108 and the spring member 106 and the required interference. As a result, the connector assembly 100 may provide increased repeatability and reliability as the connector assembly 100 is installed and used.

Turning to FIG. 7, in the mated, final position, the tap conductor 102 is captured between the channel 118 of the wedge member 106 and the inner surface 136 of the first hook portion 130. Likewise, the main conductor 104 is captured between the channel 120 of the wedge member 106 and the inner surface 136 of the second hook portion 132. As the wedge member 106 is pressed into the chamber 140 of the spring member 108, the hook portions 130, 132 are deflected in the direction of arrows D and E, respectively. The spring member 108 is elastically and plastically deflected resulting in a spring back force in the direction of arrows F and G, opposite to the directions of arrows D and E to provide a clamping force on the conductors 102, 104. A large application force, on the order of about 4000 lbs of clamping force is provided in an exemplary embodiment, and the clamping force ensures adequate electrical contact force and connectivity between the connector assembly 100 and the conductors 102, 104. Additionally, elastic deflection of the spring member 108 provides some tolerance for deformation or compressibility of the conductors 102, 104 over time, because the hook portions 130, 132 may effectively return in the directions of arrows F and G if the conductors 102, 104 deform due to compression forces. Actual clamping forces may be lessened in such a condition, but not to such an amount as to compromise the integrity of the electrical connection.

Cross-sections of the connector assembly 100 may be compared in each of the initial and final positions with reference to FIGS. 6 and 7, respectively. In the initial position, the initial width $W_{wi}$ of the wedge member 106 separates the conductors 102, 104. The initial width $W_{wi}$ is determined by the relative position of the wedge member 106 with respect to the spring member 108. In comparison, in the final position, the final width $W_{wf}$ of the wedge member 106 separates the conductors 102, 104. The final width $W_{wf}$ is determined by the relative position of the wedge member 106 with respect to the spring member 108, and is wider than the initial width $W_{wi}$. Similarly, in the initial position, the initial width $W_{si}$ of the spring member 108 extends between the outer surfaces 138 of the hook portions 130, 132. In the final position, the final width $W_{sf}$ of the spring member 108 is wider than the initial width $W_{si}$. This is due to the deflection of the hook portions 130, 132. The amount of deflection D is established by the relationship:

$$D=Wsf-Wsi \quad (2)$$

Additionally, as indicated above, interference I is created according to the following relationship:

$$I=f(D) \quad (3)$$

By strategically selecting $W_{si}$ and $W_{sf}$, repeatable and reliable performance may be provided, namely via elastic and plastic deformation of the spring member 108. Additionally, by controlling the insertion distance 170 of the wedge member 106, the deflection D may be repeatably achieved irrespective of the size of the conductors 102, 104.

Figure 9:
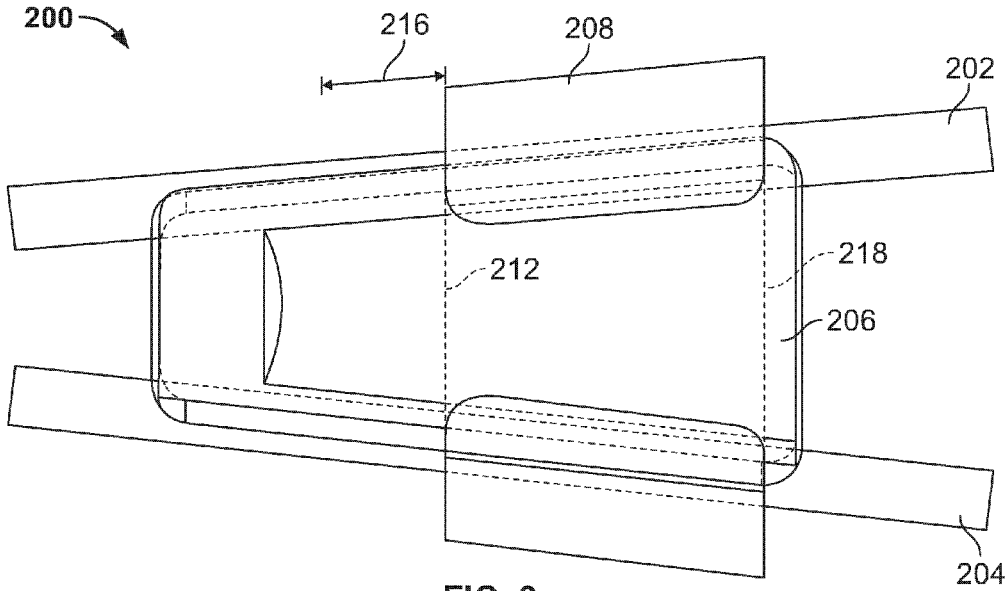
FIG. 9 is a top view of the assembly shown in FIG. 6 in a mated position.

FIG. 8 is a top view of another exemplary embodiment of a connector assembly 200 in an unmated position. FIG. 9 is a top view of the connector assembly 200 in a mated position. In contrast to the connector assembly 100 shown in FIGS. 4-7, the connector assembly 200 is adapted for connecting a tap conductor 202 to a main conductor 204 of a utility power distribution system, wherein the conductors 202, 204 have a reduced conductor gauge or size as compared to the conductors 102, 104 shown in FIGS. 4-7. In the illustrated embodiment of FIGS. 8-11, the tap conductor 102 is a 6 gauge conductor and the main conductor is a 4 gauge conductor.

Optionally, the wedge member 106 and spring member 108 illustrated in FIGS. 4-7 may accommodate the conductors 202, 204 illustrated in FIGS. 8 and 9. Because the conductors 202, 204 are smaller than the conductors 102, 104, the initial and final positions of the wedge member 106 with respect to the spring member 108 is different for the smaller conductors 202, 204 than for the larger conductors 102, 104 illustrated in FIGS. 4-7. Alternatively, and as illustrated in FIGS. 8 and 9, a different wedge member 206 and a different spring member 208 may be provided to accommodate the conductors 202, 204. The wedge member 206 and the spring member 208 may be differently sized, shaped, and/or dimensioned as compared to the wedge member 106 and the spring member 108, however, the wedge member 206 and the spring member 208 function in a substantially identical manner. For example, the overall lengths or widths of the members 206, 208 may be different than the members 106, 108. Additionally, the size of hook portions of the spring member 208 may be different than the hook portions 130, 132 of the spring member 108 or the channels (not shown) of the wedge member 206 may have a different sized or dimensioned radiused surface than the channels 118, 120 of the wedge member 106 to accommodate different sized conductors.

FIG. 8 illustrates the initial position of the wedge member 206 with respect to the spring member 208. A leading end 210 of the wedge member 206 is positioned forward of a leading edge 212 of the spring member 208. This initial position is different than the initial position of the wedge member 106 illustrated in FIG. 4. Specifically, the initial position of the wedge member 206 is forward of the initial position of the wedge member 106. As described above, the initial position is dependent upon the size of the conductors 202, 204. Because the conductors 202, 204 are a smaller gauge conductor than the conductors 102, 104, the wedge member 206 is positioned differently with respect to the spring member 208 in the initial position. Optionally, the spring member 208 is substantially centered between the leading end 210 and a trailing end 214 of the wedge member 206.

FIG. 9 illustrates the final position of the wedge member 206 with respect to the spring member 208. The wedge member 206 has moved a distance 216 during the mating process. The distance 216 is substantially equal to the distance 170 that the wedge member 106 moves with respect to the spring member 108 during the mating process of the connector assembly 100. As such, and as will be described in further detail below, the spring member 208 is deflected an amount that is substantially equal to the amount of deflection of the spring member 106. This equal deflection in each embodiment produces repeatability and reliability in the connection of the connector assemblies 100 and 200. In an exemplary embodiment, the trailing end 214 of the wedge member 206 is positioned proximate a trailing edge 218 of the spring member 208 in the final position. As described above, the wedge member 206 may have multiple initial positions and multiple final positions with respect to the spring member depending on the size of the conductors 202, 204.

Figure 10:
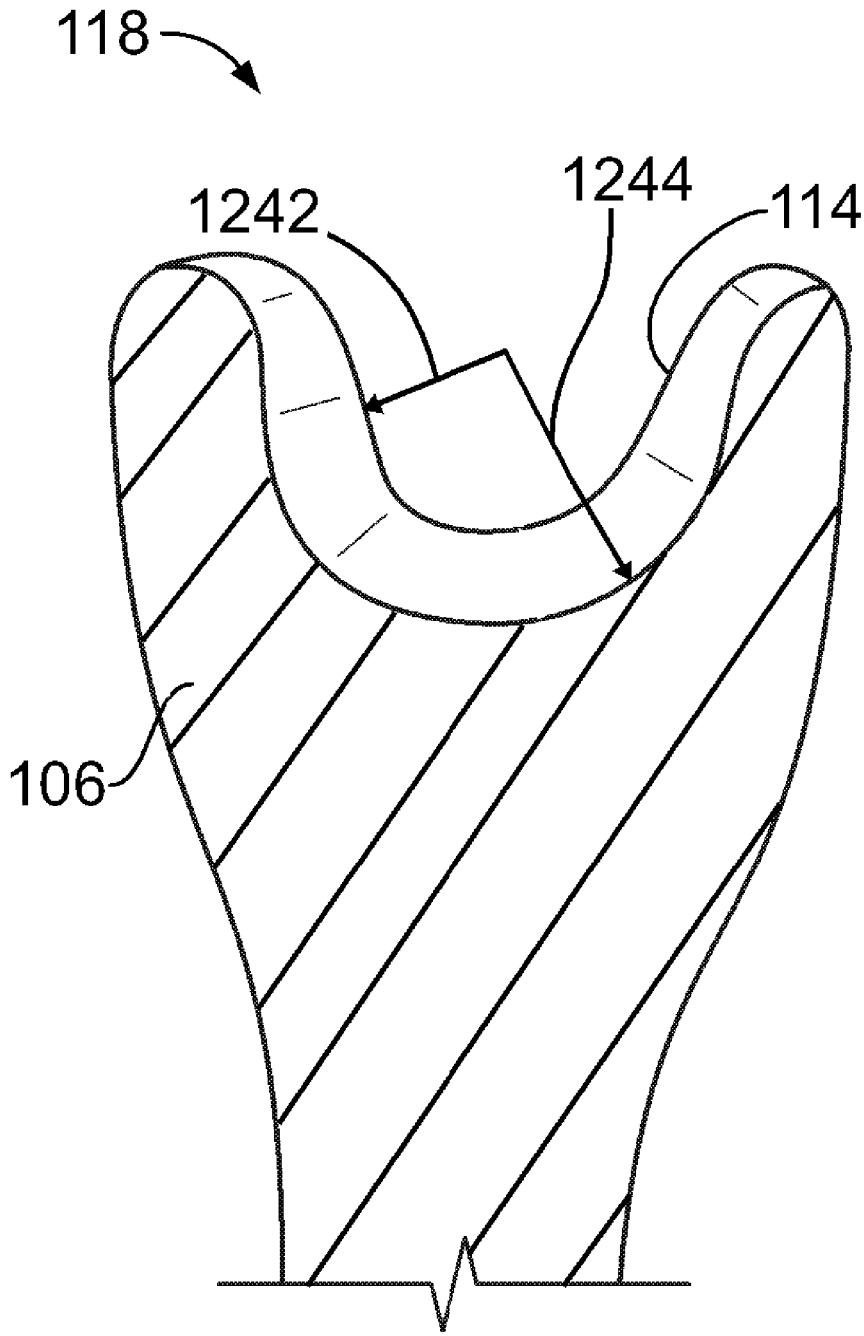
FIG. 10 is a cross sectional view of a portion of the wedge member.

FIG. 10 is a cross sectional view of a portion of the wedge member 106. FIG. 10 illustrates the channel 118 having a non-uniform radius along the length thereof. The radius and/or depths 124 (shown in FIG. 6) of the channel 118 is varied and is non-uniform along the length of the channel 118. For example, a radius 1242 at the leading end 114 is smaller than a radius 1244 at a portion of the channel 118 remote from the leading end 114 (e.g. at the portion through which the wedge member 58 is section in FIG. 10). The upward slope of the channel 118 is viewable in FIG. 10. Because the wedge member 106 engages a larger sized conductor 102 (shown in FIG. 4) proximate the leading end 114, the radius of the channel 118 proximate the leading end 114 may be wider than at the trailing end 116.

As described above, the wedge and spring members 106, 108 or 206, 208 may accommodate a greater range of conductor sizes or gauges in comparison to conventional wedge connectors. Additionally, even if several versions of the wedge and spring members 106, 108 and 206, 208 are provided for installation to different conductor wire sizes or gauges, the assembly 100 requires a smaller inventory of parts in comparison to conventional wedge connector systems, for example, to accommodate a full range of installations in the field. That is, a relatively small family of connector parts having similarly sized and shaped wedge portions may effectively replace a much larger family of parts known to conventional wedge connector systems. Particularly, because the wedge member 106 or 206 can accommodate a wide range of conductors, due at least in part to its relative size as compared to the spring member 108, 208 and the dimensions of the channels 118, 120, the wedge member 106 or 206 is able to replace the many different wedges required to handle the range of conductor sizes in the conventional wedge connector systems.

It is therefore believed that the connector assembly 100 provides the performance of conventional wedge connector systems in a lower cost connector assembly that does not require a large inventory of parts to meet installation needs. The connector assembly 100 may be provided at low cost, while providing increased repeatability and reliability as the connector assembly 100 is installed and used. The combination wedge action of the wedge and spring members 106 and 108 provides a reliable and consistent clamping force on the conductors 102 and 104 and is less subject to variability of clamping force when installed than either of known bolt-on or compression-type connector systems.

While the invention has been described in terms of various specific embodiments, those skilled in the art will recognize that the invention can be practiced with modification within the spirit and scope of the claims.

What is claimed is:

1. An electrical connector assembly comprising:

a first conductive member comprising a body having a first receiving surface for receiving a first power conductor; and a second conductive member coupled to the first conductive member, the second conductive member being electrically connected to a second power conductor, the second conductive member comprising a body having a second receiving surface for receiving the first power conductor, the first power conductor being clamped between the first and second conductive members, the second conductive member transferring power between the first power conductor and the second power conductor, wherein at least one of the first receiving surface and the second receiving surface is defined by a curved surface having a predetermined radius, the radius being non-uniform along a length thereof.

2. The connector of claim 1, wherein the first conductive member comprises a spring member comprising a generally C-shaped body, the C-shaped body formed by a first hook portion, a second hook portion, and a central section extending between the first hook portion and the second hook portion, each of the first and second hook portions being adapted to receive power conductors, and wherein the second conductive member comprises a wedge member being positionable within the spring member such that the first power conductor is received between the wedge member and the first hook portion and the second power conductor is received between the wedge member and the second hook portion.

3. The connector of claim 1, wherein the first conductive member includes a third receiving surface configured to receive the second power conductor and the second conductive member includes a fourth receiving surface configured to receive the second power conductor, the second power conductor being clamped between the third and fourth receiving surfaces.

4. The connector of claim 3, wherein at least one of the third receiving surface and the fourth receiving surface is defined by a curved surface having a predetermined radius, the radius being non-uniform along a length thereof.

5. The connector of claim 1, wherein both the first receiving surface and the second receiving surface are defined by a curved surface having a predetermined radius, the radius being non-uniform along a length thereof.

6. The connector of claim 1, wherein the first conductive member includes a channel configured to receive the first power conductor, the channel defining the first receiving surface, and wherein the second conductive member includes a channel configured to receive the first power conductor, the channel defining the second receiving surface.

7. The connector of claim 1, wherein the second conductive member extends between a leading end and a trailing end, the radius of the second receiving surface proximate to the leading end being wider than proximate to the trailing end to engage larger sized power conductors proximate the leading end.

8. The connector of claim 1, wherein the second conductive member extends between a leading end and a trailing end, the second receiving surface having a uniform depth between the leading end and the trailing end, the second receiving surface including the curved surface having the non-uniform radius along the length between the leading end and the trailing end.

9. An electrical connector assembly comprising:

a spring member comprising a generally C-shaped body, the C-shaped body formed by a first hook portion, a second hook portion, and a central section extending between the first hook portion and the second hook portion, each of the first and second hook portions being adapted to receive power conductors, the spring member being movable between a normal position and a deflected position, in the deflected position, the spring member imparts a clamping force on the power conductors; and a wedge member being positionable within the spring member to drive the spring member from the normal position to the deflected position, wherein the wedge member has first and second channels on opposite sides of the wedge member being adapted to receive the power conductors therein;

wherein at least one of the first hook portion, the second hook portion, the first channel or the second channel is defined by a curved surface having a predetermined radius, the radius being non-uniform along a length thereof.

10. The connector of claim 9, wherein both the first channel and the second channel are defined by curved surfaces having predetermined radii, the radii being non-uniform along lengths thereof.

11. The connector of claim 9, wherein the spring member extends between a leading edge and a trailing edge, the wedge member extends between a leading end and a trailing end, the wedge member having at least two final mating positions in which the position of the trailing edge of the spring member with respect to the trailing edge of the wedge member differs in the two final mating positions.

12. The connector of claim 9, wherein the wedge is positionable within the spring member to drive the spring member from the normal position to the deflected position, wherein the wedge has an initial position and a final position corresponding to the deflected position of the spring member, wherein relative positions of the wedge member with respect to the spring member in the initial position and the final position vary based on a size of the conductors.

13. The connector of claim 9, wherein the wedge member extends between a leading end and a trailing end, the radius of the first channel proximate to the leading end being wider than proximate to the trailing end to engage larger sized power conductors proximate the leading end.

14. The connector of claim 9, wherein the wedge member extends between a leading end and a trailing end, the first channel having a uniform depth between the leading end and the trailing end, the first channel including the curved surface having the non-uniform radius along the length between the leading end and the trailing end.

15. An electrical connector system for power utility transmission, the system comprising:

a main power line conductor;

a tap line conductor;

a first conductive member comprising a body having a first receiving surface for receiving the main power line conductor and a second receiving surface for receiving the tap line conductor; and a second conductive member coupled to the first conductive member, the second conductive member comprising a body having a third receiving surface for receiving the main power line conductor and a fourth receiving surface for receiving the tap line conductor, the main power line conductor being clamped between the first and third receiving surfaces, the tap line conductor being clamped between the second and fourth receiving surfaces, wherein at least one of the first receiving surface, the second receiving surface, the third receiving surface or the fourth receiving surface is defined by a curved surface having a predetermined radius, the radius being non-uniform along a length thereof.

16. The system of claim 15, wherein the first conductive member comprises a spring member comprising a generally C-shaped body, the C-shaped body formed by a first hook portion, a second hook portion, and a central section extending between the first hook portion and the second hook portion, the first hook portion receiving the main power line conductor and the second hook portion receiving the tap line conductor, and wherein the second conductive member comprises a wedge member being positionable within the spring member such that the main power line conductor is received between the wedge member and the first hook portion and the tap line conductor is received between the wedge member and the second hook portion.

17. The system of claim 15, wherein both the third receiving surface and the fourth receiving surface are defined by a curved surface having a predetermined radius, the radius being non-uniform along a length thereof.

18. The system of claim 15, wherein the first conductive member includes a channel configured to receive the main power line conductor, the channel defining the first receiving surface, and wherein the second conductive member includes a channel configured to receive the main power line conductor, the channel defining the third receiving surface.

19. The system of claim 15, wherein the second conductive member extends between a leading end and a trailing end, the radius of the third receiving surface proximate to the leading end being wider than proximate to the trailing end to engage larger sized power conductors proximate the leading end.

20. The system of claim 15, wherein the second conductive member extends between a leading end and a trailing end, the third receiving surface having a uniform depth between the leading end and the trailing end, the third receiving surface including the curved surface having the non-uniform radius along the length between the leading end and the trailing end.

* * * * *